US008615180B2

(12) United States Patent
Fujita

(10) Patent No.: US 8,615,180 B2
(45) Date of Patent: Dec. 24, 2013

(54) IMAGE FORMING APPARATUS HAVING BELT DRIVE CONTROL

(75) Inventor: Tetsuya Fujita, Ebina (JP)

(73) Assignee: Fuji Xerox Co., Ltd., Kanagawa (JP)

( * ) Notice: Subject to any disclaimer, the term of this patent is extended or adjusted under 35 U.S.C. 154(b) by 224 days.

(21) Appl. No.: 12/787,254

(22) Filed: May 25, 2010

(65) Prior Publication Data

US 2011/0081159 A1 Apr. 7, 2011

(30) Foreign Application Priority Data

Oct. 7, 2009 (JP) ..... 2009-233175

(51) Int. Cl.
*G03G 15/20* (2006.01)

(52) U.S. Cl.
USPC ..... 399/71

(58) Field of Classification Search
USPC ..... 399/71
See application file for complete search history.

(56) References Cited

U.S. PATENT DOCUMENTS

2007/0286636 A1* 12/2007 Inada et al. ..... 399/101

FOREIGN PATENT DOCUMENTS

JP 07036249 A * 2/1995
JP 2000081795 A * 3/2000
JP 2001356558 A * 12/2001
JP 2004246199 A * 9/2004
JP 2005024897 A * 1/2005
JP 2005-92144 A 4/2005
JP 2005-242178 A 9/2005
JP 2005-331575 A 12/2005
JP 2005331575 A * 12/2005
JP 2006-215472 A 8/2006
JP 2009-186681 A 8/2009

OTHER PUBLICATIONS

Computer translation of JP2005-024897A to Sukuzi, Jan. 2005.*
Computer translation of JP2005-331575A to Nishikawa, Dec. 2005.*
Japanese office Action issued in corresponding JP Patent Application No. 2009-233175 dated Sep. 17, 2013.

* cited by examiner

*Primary Examiner* — Quana M Grainger
(74) *Attorney, Agent, or Firm* — Sughrue Mion, PLLC

(57) ABSTRACT

An image forming apparatus includes an image carrier member, an intermediate transfer member, a transfer unit, a cleaning unit, and a driving controller. The image carrier member carries a toner image. The toner image carried on the image carrier member is first-transferred to the intermediate transfer member. The transfer unit second-transfers the toner image first-transferred to the intermediate transfer member onto a recording medium. The cleaning unit removes residual toner on the intermediate transfer member after the second transfer. The driving controller changes a driving time of the intermediate transfer member after completion of image formation in accordance with information about a life of the intermediate transfer member.

20 Claims, 9 Drawing Sheets

IMAGE FORMING APPARATUS HAVING BELT DRIVE CONTROL

CROSS-REFERENCE TO RELATED APPLICATIONS

This application is based on and claims priority under 35 USC 119 from Japanese Patent Application No. 2009-233175 filed Oct. 7, 2009.

BACKGROUND (i) Technical Field

The present invention relates to an image forming apparatus.

(ii) Related Art

In general, intermediate transfer members mounted in image forming apparatuses are replaceable by users who use the image forming apparatuses when failure or degradation occurs.

SUMMARY

According to an aspect of the invention, there is provided an image forming apparatus including an image carrier member, an intermediate transfer member, a transfer unit, a cleaning unit, and a driving controller. The image carrier member carries a toner image. The toner image carried on the image carrier member is first-transferred to the intermediate transfer member. The transfer unit second-transfers the toner image first-transferred to the intermediate transfer member onto a recording medium. The cleaning unit removes residual toner on the intermediate transfer member after the second transfer. The driving controller changes a driving time of the intermediate transfer member after completion of image formation in accordance with information about a life of the intermediate transfer member.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described hereinafter with reference to the drawings.

First Exemplary Embodiment

Figure 1:
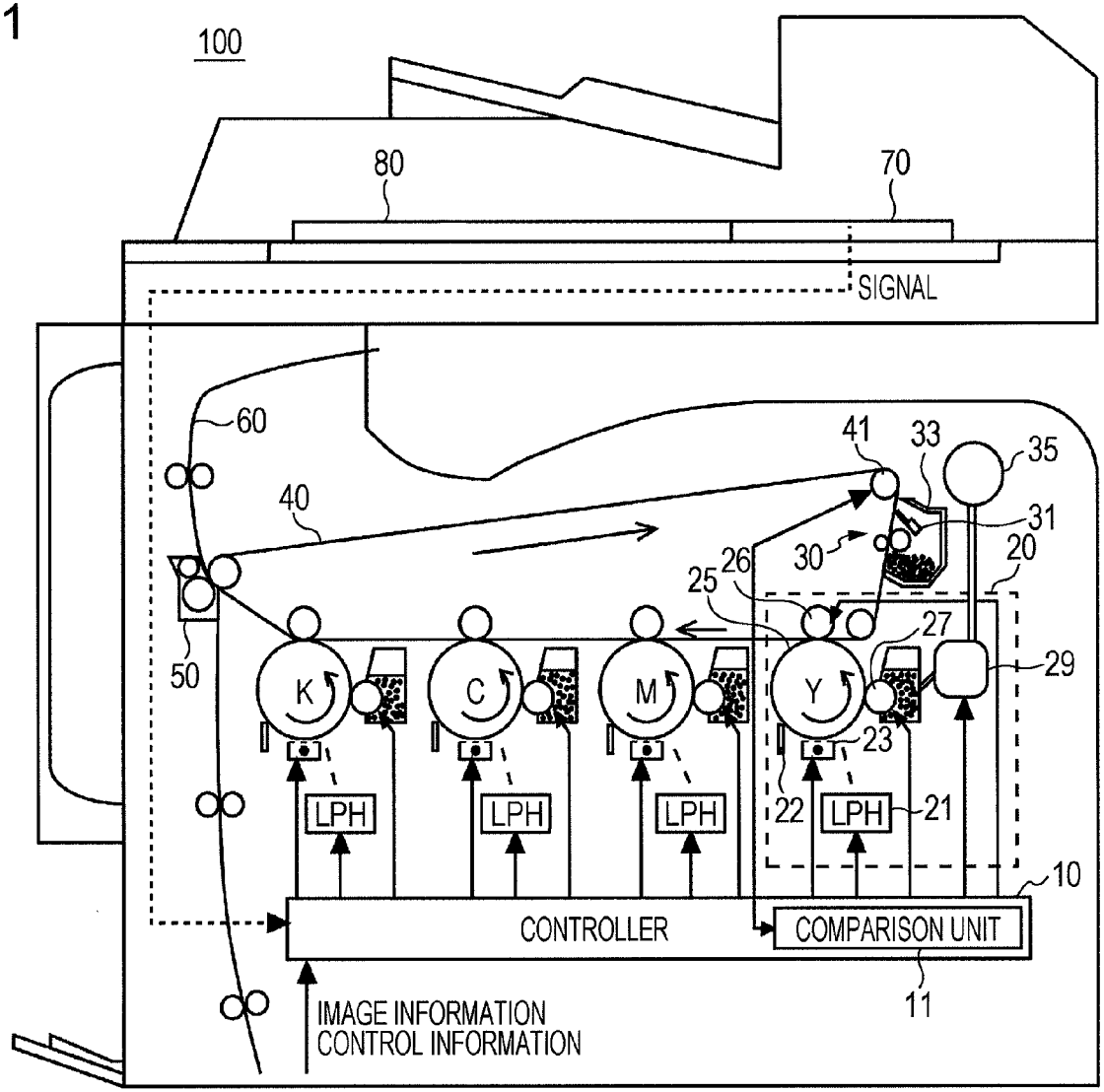
FIG. 1 is a diagram illustrating an example configuration of an image forming apparatus.

FIG. 1 is a diagram illustrating an example configuration of an image forming apparatus 100.

The image forming apparatus 100 includes at least a controller 10, image forming units 20, a cleaning device 30 serving as a cleaning unit, an intermediate transfer member 40, a second transfer device 50 serving as a transfer unit, an input unit 70, and a display 80.

A driving controller according to an exemplary embodiment of the present invention is configured using the controller 10 and a drive motor 41 described below. In FIG. 1, a tandem-type image forming apparatus 100 is illustrated. A rotary-type image forming apparatus 100 may also be used.

The controller 10 controls the operation of the individual elements included in the image forming units 20, the cleaning device 30, the intermediate transfer member (for example, a transfer belt having a belt shape) 40, and the second transfer device 50 in accordance with a signal input to the input unit 70. The controller 10 controls the operation of the intermediate transfer member 40 by controlling the operation of the drive motor 41. The signal may be transmitted from a personal computer (PC). The hardware configuration or detailed functionality of the controller 10 will be described below.

Each of the image forming units 20 includes a light emitting diode (LED) printing head (LPH) 21 having LEDs arranged in an array, which may be an example of an exposure unit, a cleaning blade 22 as an example of a cleaning unit, a charging device 23 as an example of a charging unit, a photoconductor drum 25 as an example of an image carrier member, a transfer roller 26 as an example of a first transfer unit, a developing device 27 as an example of a developing unit, and a dispenser 29 having, as an example of a unit that supplies toner to the developing device 27, an internal unit that transports toner (not illustrated).

In FIG. 1, image forming units 20 of yellow (Y), magenta (M), cyan (C), and black (K) have a similar configuration. Dispensers 29 are also configured for magenta, cyan, and black. However, the dispensers 29 for the colors other than that for yellow are omitted in the illustration. The following description will be given in the context of, by way of example, the image forming unit 20 of yellow.

The LPH 21 includes an LED array, a drive integrated circuit (IC), and a rod lens array. The LPH 21 performs exposure by causing the multiple LEDs to emit light to the photoconductor drum 25 in accordance with the amount of exposure controlled by the controller 10.

The charging device 23 may be configured using, for example, a conductive elastic roller. The charging device 23 charges the photoconductor drum 25 in accordance with the potential controlled by the controller 10. Specifically, the charging device 23 is brought into contact with the photoconductor drum 25 to apply a voltage thereto, thus allowing the photoconductor drum 25 to be positively charged.

The photoconductor drum 25 may be formed of a cylindrical aluminum member having a photoconductive (for example, amorphous silicon (a-Si)) layer formed on a surface thereof. The photoconductor drum 25 rotates (in FIG. 1, counterclockwise) about the center of a top surface (or bottom surface) thereof in accordance with the control of the controller 10. The drive motor 41 is used as the driving source of the photoconductor drum 25 and the driving source of the intermediate transfer member 40. Therefore, when the controller 10 causes the drive motor 41 to stop, both the intermediate transfer member 40 and the photoconductor drum 25 stop their operation. As described above, the photoconductor drum 25 is charged by the charging device 23, and the charge on a scanned portion is dissipated when the LPH 21 emits light. Then, the toner supplied from the developing device 27 described below is attached to the photoconductor drum 25. As a result, a toner image generated based on a toner band or image information described below is carried on the photoconductor drum 25.

The transfer roller 26 first-transfers a toner band or toner image attached to the photoconductor drum 25 onto the intermediate transfer member 40. The transfer roller 26 positively charges the intermediate transfer member 40 in accordance with the transfer potential control performed by the controller 10. As a result, the negative-potential toner attached to the photoconductor drum 25 is transferred to the intermediate transfer member 40. Since the transfer roller 26 rotates (in FIG. 1, clockwise) so as to allow the intermediate transfer member 40 to move in the same direction as that of the photoconductor drum 25, the intermediate transfer member 40 moves so as to be pushed in the direction indicated by the arrow. The toner remaining on the photoconductor drum 25 after first transfer is scraped off by the cleaning blade 22 that is in contact with the photoconductor drum 25.

The developing device 27 includes a cylindrical aluminum member (hereinafter referred to as a "development roller") having a magnet (magnet roll) mounted therein. The developing device 27 is replenished with toner supplied from a toner bottle 35 through the dispenser 29. The replenished toner particles are mixed with carrier particles and are negatively charged. A powder for use in development, such as the toner and the carrier, is called developer. Due to the magnetic force of the magnet roll, the developer forms a magnetic brush on the development roller, which is brought into contact with the photoconductor drum 25. Then, in accordance with the potential of the developing device 27 controlled by the controller 10, the toner on the development roller is developed on the photoconductor drum 25. Thus, a toner image is formed on the photoconductor drum 25, and is then first-transferred to the intermediate transfer member 40.

Accordingly, in addition to the toner image of yellow, toner images of magenta, cyan, and black are first-transferred to the intermediate transfer member 40. The toner images of the respective colors independently or overlappingly form an image. In the overlapping of the toner images, the intermediate transfer member 40 is driven so that, for example, the toner images of magenta and cyan are first-transferred to the area where the toner image of yellow has been first-transferred, and therefore, a color image is formed.

The intermediate transfer member 40 is still driven even after the toner bands or toner images are first-transferred, and the area that has undergone first transfer reaches the second transfer device 50. The second transfer device 50 second-transfers the toner images first-transferred to the intermediate transfer member 40 onto a recording medium 60. Examples of the recording medium 60 include recording paper and films including a polyester film.

The second transfer device 50 positively charges the recording medium 60 in accordance with the transfer potential control performed by the controller 10. As a result, the negative-potential toner images attached to the intermediate transfer member 40 are attracted to the recording medium 60. The toner images attracted to the recording medium 60 are fixed to the recording medium 60 by a fixing device (not illustrated).

The cleaning device 30 includes a cleaning blade 31 and a toner collection unit 33. The cleaning blade 31 may be formed of, for example, a thin plate of rubber material or the like. While a cleaning blade made of rubber material is used by way of example, for example, a metal blade formed of a thin plate of SUS material or the like or a brush formed of acrylic resin may be used as a cleaning device.

The cleaning device 30 removes a residual toner band or toner image that remains on the intermediate transfer member 40 after second transfer performed by the second transfer device 50. Specifically, the cleaning blade 31 scrapes and cleans off the residual toner that remains on the intermediate transfer member 40 after second transfer. The toner collection unit 33 collects the toner scraped off by the cleaning blade 31.

Thus, the amount of residual toner on the intermediate transfer member 40 is reduced or no toner remains thereon. When the intermediate transfer member 40 is further driven after the collection of the toner, the transfer roller 26 first-transfers new toner to the intermediate transfer member 40 from which the toner has been removed. Accordingly, because of the removal of the residual toner by the cleaning device 30, the intermediate transfer member 40 is cleaned and is subjected to first-transfer each time second transfer is performed. Therefore, a desired image is formed on the recording medium 60 which is then output.

The input unit 70 may be configured using, for example, an operation panel or operation buttons. In response to an input to the input unit 70 by the user of the image forming apparatus 100, the input unit 70 outputs a signal based on the input to the controller 10. The controller 10 performs control in accordance with the input signal to drive, for example, the intermediate transfer member 40 by a predetermined amount. Examples of the predetermined amount include 50 mm to 90 mm, 100 mm to 140 mm, 150 mm to 190 mm, 200 mm to 240 mm, 250 mm to 290 mm, 300 mm to 340 mm, and 350 mm to 400 mm. The above amounts may be further divided in units of 5 mm (for example, 300 mm to 305 mm), or may be roughly divided in units of 100 mm (for example, 50 mm to 150 mm). The predetermined amount may also be expressed in seconds (for example, two seconds, three seconds, or four seconds). Time steps of 0.1 seconds, 0.2 seconds, or 0.5 seconds may be used. The amount of driving of the intermediate transfer member 40 may be changed with consideration of the size of the image forming apparatus 100 or the arrangement of the devices included in the image forming apparatus 100 (for example, the image forming units 20, the cleaning device 30, the intermediate transfer member 40, the second transfer device 50, and the like).

Thus, the intermediate transfer member 40 is driven by a predetermined amount in accordance with the input to the input unit 70 by the user. Since the amount of driving is limited, the residual toner on the intermediate transfer member 40 after second transfer is removed while the abrasion of the photoconductor drum 25 is suppressed or reduced, in contrast with the case where the amount of driving is not limited. In particular, if toner remains on the intermediate transfer member 40 after second transfer, an input by a user allows the toner to reach the cleaning device 30 and to be removed. Therefore, a user who wishes to replace the intermediate transfer member 40 may replace the intermediate transfer member 40 after toner on the intermediate transfer member 40 has been removed. This prevents toner from being attached to the user's clothing or to parts that are not covered by the clothing (for example, hand, foot, arm, or the head) or prevents toner from being scattered in the surrounding area.

The signal may not necessarily be output from the input unit 70 included in the image forming apparatus 100 but may be output from a PC or a mobile information terminal as described above. In this case, the PC or mobile information terminal may be connected to the image forming apparatus 100 via wired or wireless transmission.

Further, the controller 10 may further include a comparison unit 11 so that the comparison unit 11 drives the intermediate transfer member 40.

The comparison unit 11 compares the operating state of the intermediate transfer member 40 with a predetermined operating state. Examples of the operating state include the driving time or the number of rotation of the intermediate transfer member 40, the driving time or the number of rotation of the drive motor 41, the number of images formed when printed on a recording medium 60 of A4 size in the lateral direction, the driving time of the transfer rollers for first transfer and second transfer, and the value of current flowing when a voltage is applied to the intermediate transfer member 40. The above operating states may be stored in a storage device described below. The operating states may be affected by the life of the intermediate transfer member 40.

In response to the excess of the operating state of the intermediate transfer member 40 over the predetermined operating state as a result of the comparison by the comparison unit 11, the image forming apparatus 100 prompts a user to replace the intermediate transfer member 40. Then, the user enters an input indicating the replacement of the intermediate transfer member 40 using the input unit 70. In this manner, when the intermediate transfer member 40 is driven in accordance with the input from the input unit 70, the intermediate transfer member 40 is driven in time with the replacement of the intermediate transfer member 40 by the user, thus preventing or reducing the abrasion of the photoconductor drum 25. The display 80 may be configured using, for example, a liquid crystal monitor or the like, and displays information such as information input by a user, information regarding the image currently being formed, information about an image accumulated in the image forming apparatus 100, and information regarding the records of usage or the life of components included in the image forming units 20.

While the intermediate transfer member 40 is driven in accordance with an input from the input unit 70 about the replacement of the intermediate transfer member 40, if a user enters an input at the timing of image formation after the input is entered by the user, such as during the image formation operation or when an image formation reservation is ongoing, the driving time of the intermediate transfer member 40 may be changed after the completion of the image formation operation in accordance with the input from the input unit 70.

Instead of the drive control based on the input from the input unit 70 described above, in accordance with the excess of the operating state of the intermediate transfer member 40 over the predetermined operating state, the replacement of the intermediate transfer member 40 may be prompted and the operation of the drive motor 41 may be controlled so that the intermediate transfer member 40 is driven by a predetermined amount. In this case, because control is not performed in accordance with the user's input indicating the replacement of the intermediate transfer member 40, less operation load is placed on the user.

Figure 2:
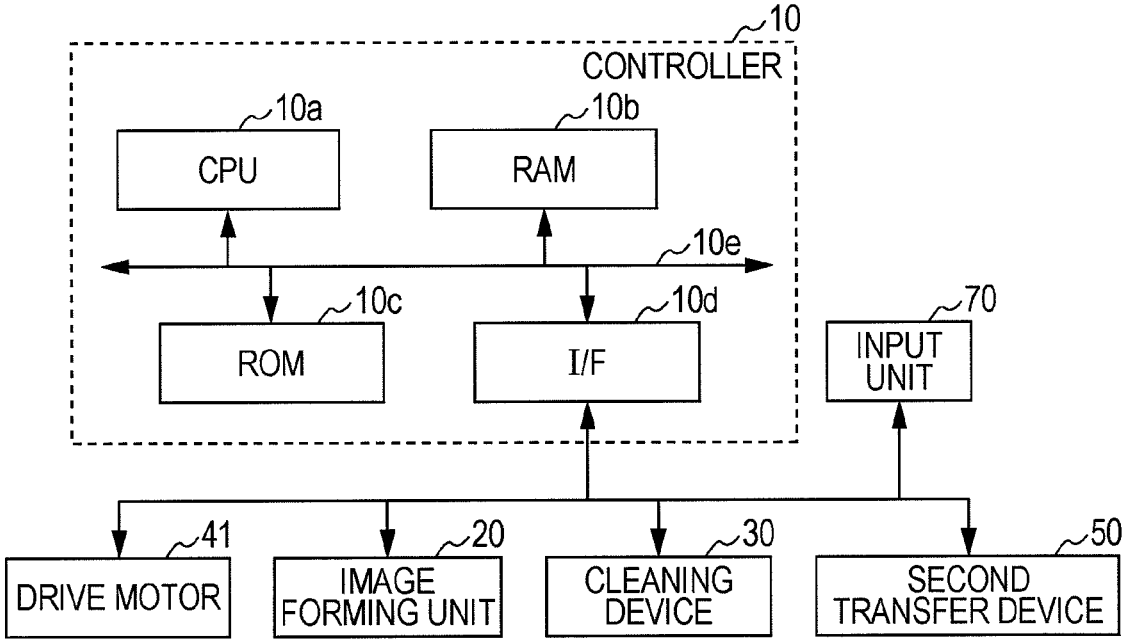
FIG. 2 is a block diagram illustrating an example hardware configuration of a controller.

FIG. 2 is a block diagram illustrating a hardware configuration of the controller 10, by way of example.

As illustrated in FIG. 2, the controller 10 is implemented by a hardware configuration in which a central processing unit (CPU) 10*a*, a random access memory (RAM) 10*b* such as a static RAM (SRAM), a dynamic RAM (DRAM), a synchronous DRAM (SDRAM), or a non-volatile RAM (NVRAM), a read only memory (ROM) 10*c* such as a flash memory, an interface (I/F) 10*d*, and other suitable devices are connected to one another via a bus 10*e*.

The CPU 10*a* reads a desired program stored in a storage device such as the ROM 10*c*, and performs computation according to the program, thereby implementing the individual functions of the controller 10 illustrated in FIG. 1. The program may be a program according to a flowchart described below.

Figure 3:
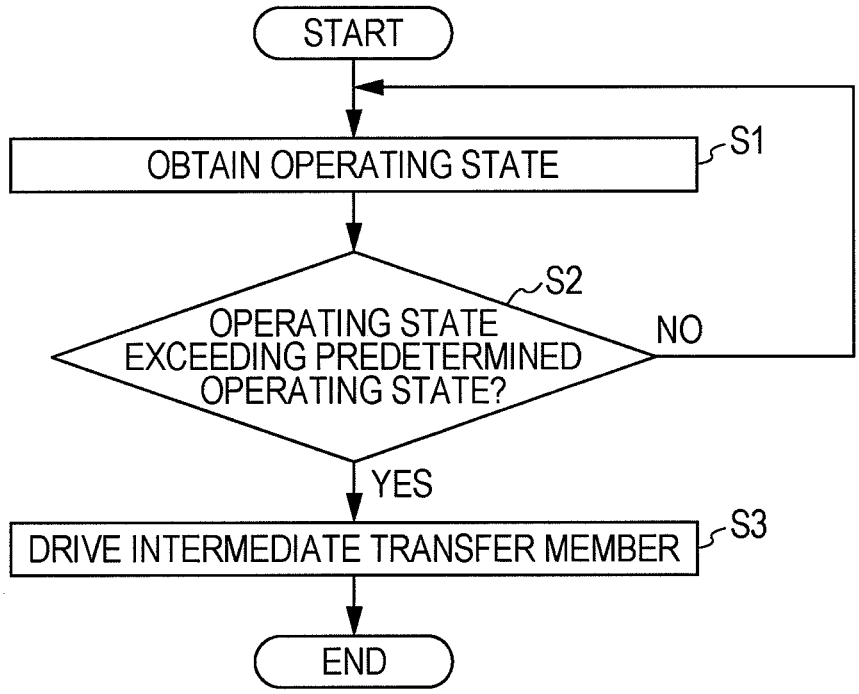
FIG. 3 is a flowchart depicting an example of the operation of a comparison unit.

FIG. 3 is a flowchart illustrating an example of the operation of the comparison unit 11.

The comparison unit 11 obtains the operating state of the intermediate transfer member 40 (step S1). Then, the comparison unit 11 compares the obtained operating state with an operating state stored therein in advance (step S2). When it is determined as a result of the comparison that the operating state of the intermediate transfer member 40 exceeds the predetermined operating state (YES in step S2), the comparison unit 11 causes the intermediate transfer member 40 to be driven by a predetermined amount (step S3).

Next, toner remaining on the intermediate transfer member 40 after second transfer will be described with reference to FIGS. 4 and 5.

Figure 4:
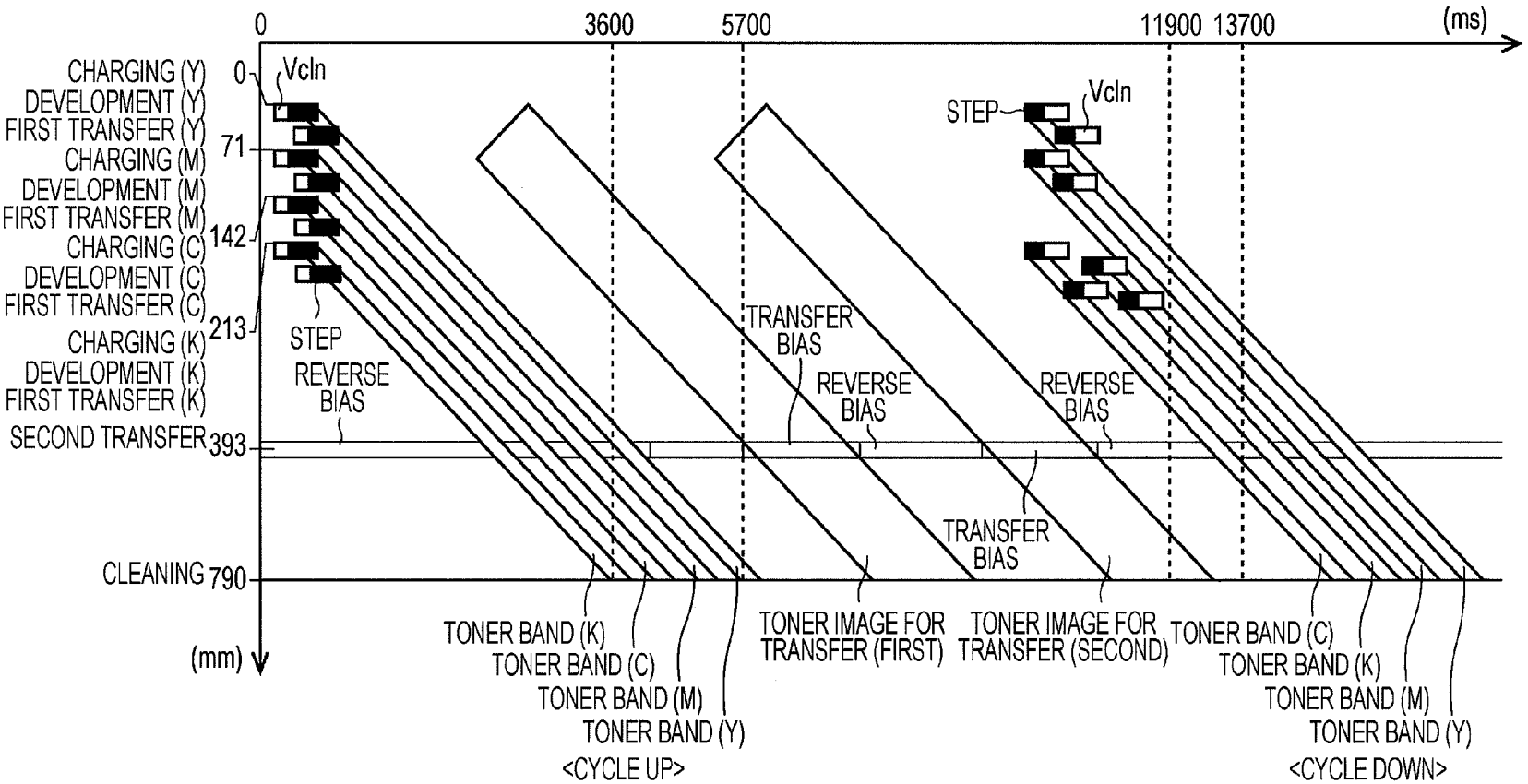
FIG. 4 illustrates an example of a print timing diagram according to a first exemplary embodiment.

FIG. 4 illustrates an example of a print timing diagram according to the first exemplary embodiment.

The ordinate of the print timing diagram describes, as reference value "0", a position on the intermediate transfer member 40, which is obtained at the time of charging of the photoconductor drum 25 of yellow. In addition to the reference value, positions on the intermediate transfer member 40, which are obtained at the time of operation of the devices included in the image forming apparatus 100, are also described. In FIG. 4, the position at "charging (M)" is 71 mm downstream of the reference value "0". Similarly, the position at "charging (C)" is 142 mm downstream of the reference value "0". The position at "charging (K)" is 213 mm downstream of the reference value "0". The position at "second transfer" is 393 mm downstream of the reference value "0". The position at "cleaning" is 790 mm downstream of the reference value "0". The positions at "developing (Y)" and "first transfer (Y)" are located between the positions at "charging (Y)" and "charging (M)" in the order illustrated in FIG. 4 although not illustrated in FIG. 4. The abscissa of the print timing diagram describes the driving time of the intermediate transfer member 40 after the intermediate transfer member 40 has been driven. The illustrated positions and time points are merely examples, and may be changed as appropriate in accordance with design.

The print timing diagram illustrated in FIG. 4 also describes toner bands that are assumed to occur on the surfaces of the photoconductor drums 25 of the respective colors at the cycle up of the charging devices 23 and the developing devices 27, toner bands that are assumed to occur on the surfaces of the photoconductor drums 25 of the respective colors at the cycle down of the charging devices 23 and the developing devices 27, and toner images that are used for the transfer (first transfer and second transfer) to the recording medium 60 for the period of time between the cycle up and the cycle down.

Here, the toner bands and the toner images will be briefly described in the context of the toner band (Y) at the cycle up and the first toner image for transfer, by way of example.

Regarding the toner band (Y), when a predetermined amount of time has elapsed since a time of 0 ms, as illustrated in FIG. 4, the charging device 23 charges the photoconductor drum 25. Then, the photoconductor drum 25 is exposed to light (not illustrated), and the developing device 27 causes toner to be attracted to the photoconductor drum 25. Further, the transfer roller 26 transfers the toner attracted to the photoconductor drum 25 onto the intermediate transfer member 40. As a result, the toner band of yellow is transferred to the intermediate transfer member 40. Since the intermediate transfer member 40 is rotationally driven inside the image forming apparatus 100, the toner band of yellow moves inside the image forming apparatus 100 with the lapse of the driving time of the intermediate transfer member 40 if no other color (magenta, cyan, black) of toner is transferred to the transferred area of the toner band of yellow. Therefore, for example, around a time of 3600 ms, the toner band of yellow reaches the position of the second transfer device 50.

Here, at the position of the second transfer device 50, as illustrated in FIG. 4, a reverse bias is applied to the recording medium 60. That is, a bias having the same polarity as that of toner having a negative polarity is applied to the recording medium 60 by the second transfer device 50. Consequently, the toner band of yellow on the intermediate transfer member 40 is not transferred to the recording medium 60. Thus, the toner band of yellow remains on the intermediate transfer member 40. The toner band of yellow remaining on the intermediate transfer member 40 is removed by the cleaning device 30 after a certain period of time has elapsed. In FIG. 4, for example, around a time of 5700 ms, the toner band of yellow is removed.

While the operation up to the removal of the toner band of yellow at the cycle up has been described, the toner bands of the other colors (magenta, cyan, black) are also removed by the cleaning device 30 after a certain period of time has elapsed since the first transfer of the toner bands to the intermediate transfer member 40.

On the other hand, a toner image for transfer generated based on image information is first-transferred onto the intermediate transfer member 40 after a predetermined period of time has elapsed since the generation of the toner bands of the respective colors (yellow, magenta, cyan, black). The first-transferred toner image reaches the position of the second transfer device 50 in accordance with the driving of the intermediate transfer member 40.

At the position of the second transfer device 50, as illustrated in FIG. 4, a transfer bias is applied to the recording medium 60. That is, a bias having a polarity different from that of toner having a negative polarity is applied to the recording medium 60 by the second transfer device 50. As a result, the toner image on the intermediate transfer member 40 is second-transferred to the recording medium 60. Meanwhile, a toner image that is left after second transfer remains on the intermediate transfer member 40. The toner image remaining on the intermediate transfer member 40 is removed by the cleaning device 30 after a certain period of time has elapsed. The second toner image undergoes a process similar to that for the first toner image.

Here, at the cycle up and cycle down of the image forming unit 20 described above, the application of voltage to the charging device 23 and the developing device 27 is started and stopped. Here, there is a difference in and there is variation in the cycle up/cycle down speed of power supply device between the power supply for the charging device 23 and the power supply for the developing device 27. In addition, there are also variations in response speed or rotation after the application of voltage to the photoconductor drum 25 by the charging device 23. Thus, it is difficult to make the rising/falling timing of the charge potential on the photoconductor drum 25 match the rising/falling timing of developing bias at the developing position.

Thus, a potential difference occurs between the charge potential on the photoconductor drum 25 and the potential of the development roller. If the developing bias of the development roller is turned off or the rising time thereof is delayed with respect to the surface potential of the photoconductor drum 25 when the charged area of the photoconductor drum 25 moves to the developing position that faces the development roller of the developing device 27 in accordance with the rotation of the photoconductor drum 25, due to the potential difference between the charge potential on the photoconductor drum 25 and the potential of the development roller, an electric field having an orientation that causes the carrier of the developer charged with a polarity opposite to that of the toner to be transferred from the development roller to the surface of the photoconductor drum 25 is formed between the photoconductor drum 25 and the development roller. If the rising time of the surface potential of the photoconductor drum 25 is delayed with respect to the rising time of the developing bias, on the other hand, an electric field having an orientation that causes the toner to be transferred from the development roller to the surface of the photoconductor drum 25 is formed.

Since the effect on the photoconductor drum 25 is larger when the carrier is developed than when the toner is developed, the timing of starting and stopping the application of voltage to the charging device 23 and the developing device 27 is set so that the toner may be developed on the photoconductor drum 25 when the application of voltage is started and stopped.

In the exemplary embodiment, since the toner is likely to be developed in a band shape on the photoconductor drum 25 at the time of starting and stopping the application of voltage, the term "toner band" is used. However, the toner shape is not limited to the band shape.

Subsequently, the second toner image for transfer and the removal of the toner band at the cycle down will be described.

As illustrated in FIG. 4, residue of the second toner image on the intermediate transfer member 40 after second transfer is removed by the cleaning device 30. In this case, if the driving of the intermediate transfer member 40 is stopped before the completion of removal, a portion of the residue of the toner image is not removed but still remains on the intermediate transfer member 40. Specifically, in FIG. 4, the residue of the second toner image, which still remains on the intermediate transfer member 40 even after the second transfer processing has been performed and which has not reached the cleaning device 30, is left on the intermediate transfer member 40. That is, when the driving of the intermediate transfer member 40 is stopped at a time of 11900 ms, the residue after that time is left on the intermediate transfer member 40. The residue of the toner may stain the user's clothing during the replacement of the intermediate transfer member 40.

In the exemplary embodiment, the intermediate transfer member 40 is driven by a predetermined amount in order to prevent a toner image from being left on the intermediate transfer member 40 while suppressing or reducing the abrasion of the photoconductor drums 25 which may be caused by the intermediate transfer member 40 being driven. In FIG. 4, the intermediate transfer member 40 may be driven until around a time of 13700 ms, thus allowing the toner image described above to be removed by the cleaning device 30 to address the inconvenience that will be caused by the toner image being left on the intermediate transfer member 40. In particular, since the amount of driving of the intermediate transfer member 40 is limited, the abrasion of photoconductor drums 25 is suppressed or reduced in contrast with the case where the amount of driving is not limited. This prevents a residual toner image on the intermediate transfer member 40 from staining the user's clothing or the like during the replacement of the intermediate transfer member 40.

The toner bands of the respective colors may remain on the intermediate transfer member 40 without reaching the cleaning device 30 at the cycle down. However, the removal of at least the leading end of the residual toner area on the intermediate transfer member 40 would reduce the probability of staining of the user's clothing or the like. In the exemplary embodiment, the leading end of the toner may correspond to a toner image that is not second-transferred but remains on the intermediate transfer member 40.

Figure 5A:
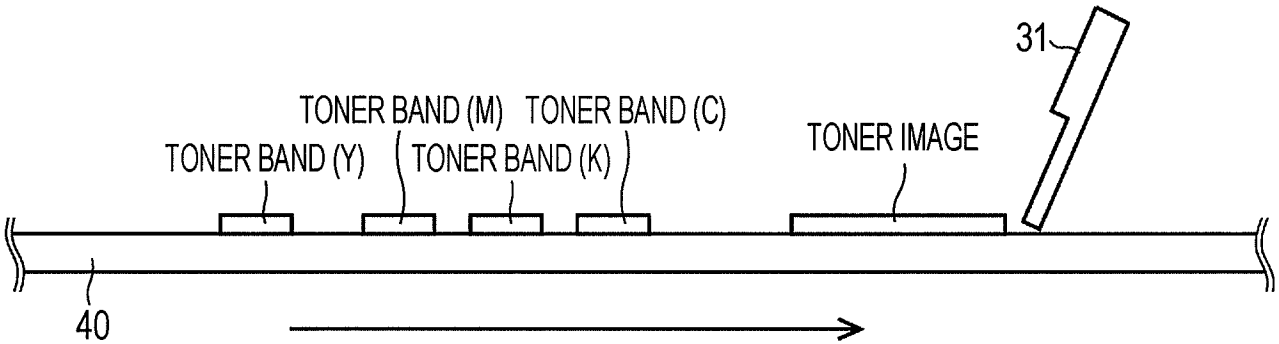
FIGS. 5A and 5B are conceptual diagrams illustrating removal of toner according to the first exemplary embodiment.
Figure 5B:
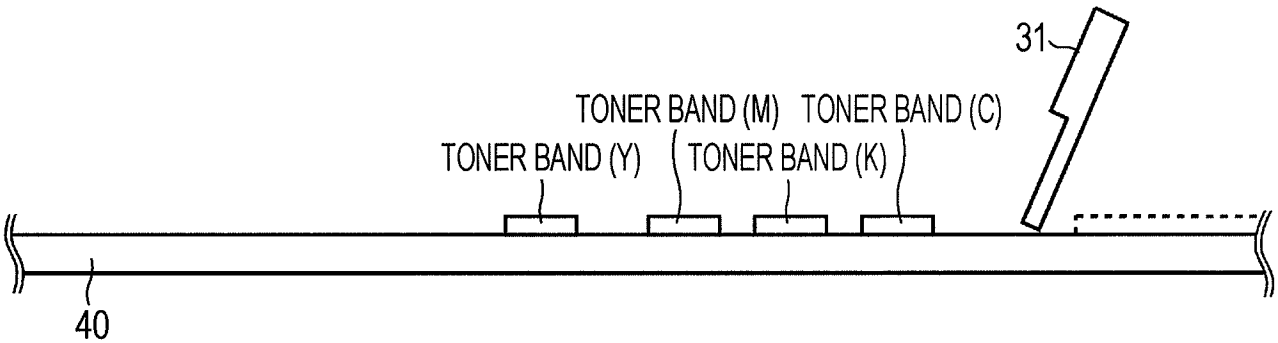

FIGS. 5A and 5B are conceptual diagrams of removal of toner according to the first exemplary embodiment.

As illustrated in FIG. 5A, the residue of the second toner image and the toner bands of the respective colors remain on the intermediate transfer member 40, as described with reference to FIG. 4. Therefore, the intermediate transfer member 40 may be driven by an amount corresponding to the amount of removal of the residue of the toner image located at the leading end by the cleaning blade 31. Consequently, as illustrated in FIG. 5B, the residue of the toner image is removed while the abrasion of the photoconductor drums 25 is suppressed or reduced.

Second Exemplary Embodiment

Next, a second exemplary embodiment of the present invention will be described with reference to FIG. 6 and FIGS. 7A and 7B.

Figure 6:
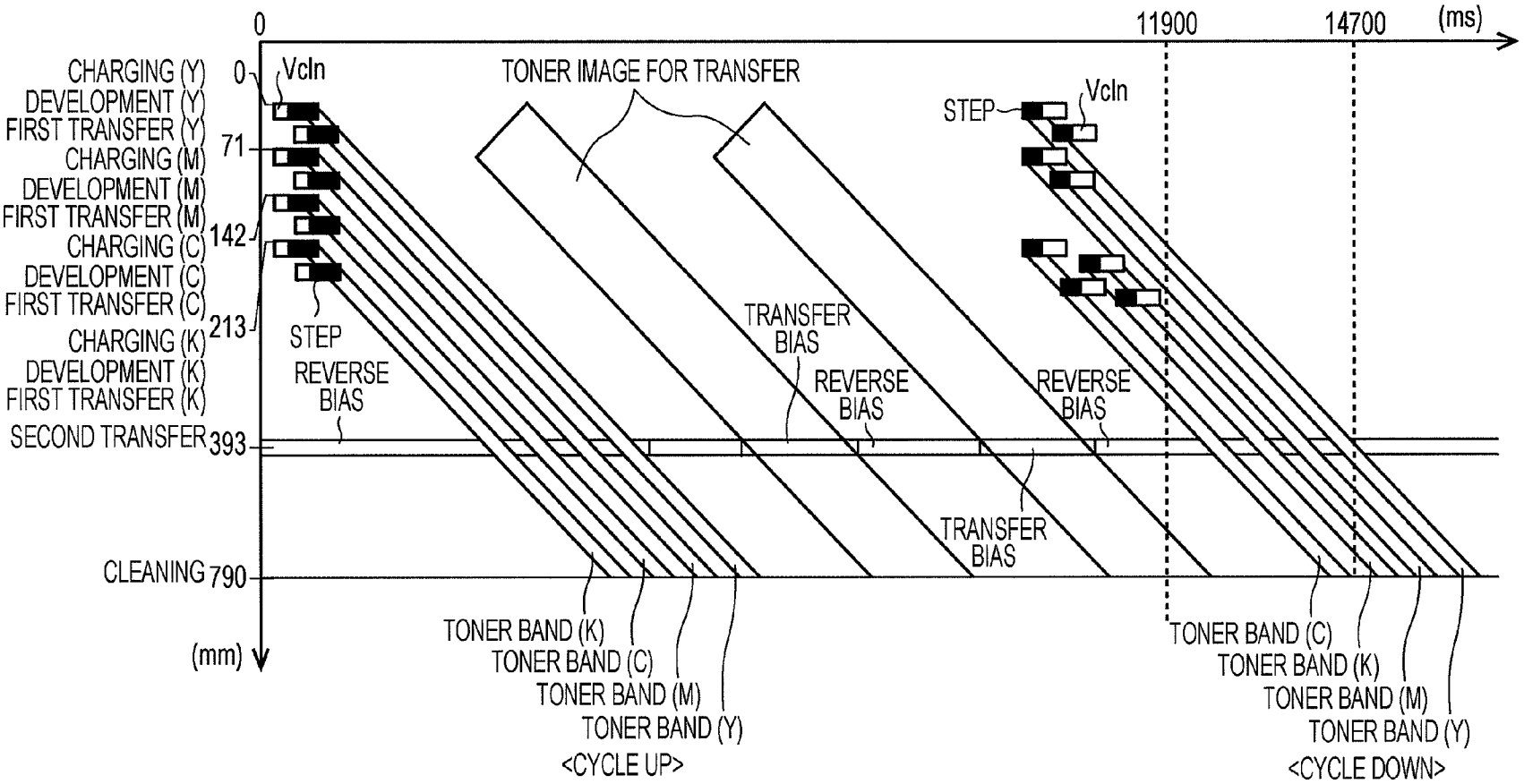
FIG. 6 illustrates an example of a print timing diagram according to a second exemplary embodiment.
Figure 7A:
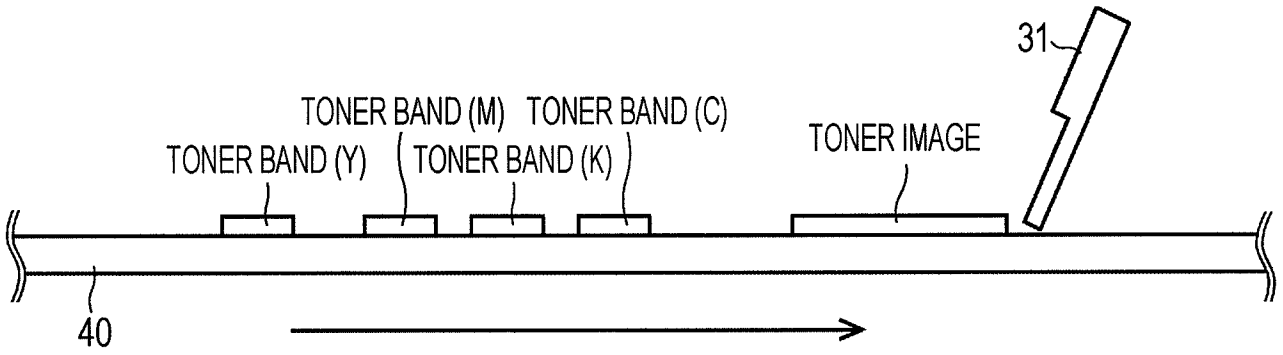
FIGS. 7A and 7B are conceptual diagrams illustrating removal of toner according to the second exemplary embodiment.
Figure 7B:
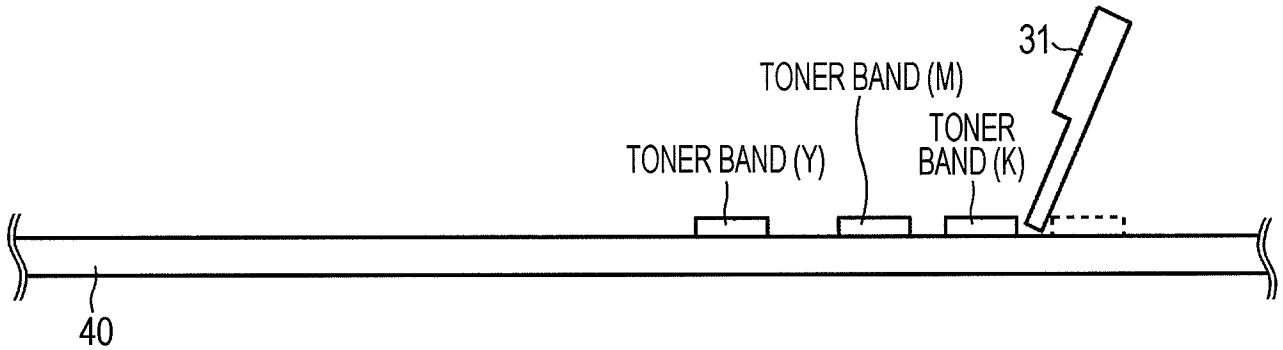

FIG. 6 illustrates an example of a print timing diagram according to the second exemplary embodiment, and FIGS. 7A and 7B are conceptual diagrams of removal of toner according to the second exemplary embodiment. Elements similar to those in the conceptual diagrams of removal of toner illustrated in FIGS. 5A and 5B are assigned the same reference numerals, and descriptions thereof are omitted. The same applies to the following exemplary embodiment.

In the exemplary embodiment, the amount of driving of the intermediate transfer member 40 is larger than that in the first exemplary embodiment. Specifically, as illustrated in FIG. 6, the driving of the intermediate transfer member 40 is not stopped at a time of 11900 ms, and the intermediate transfer member 40 is driven until around a time of 14700 ms. Consequently, as illustrated in FIGS. 7A and 7B, in addition to the second toner image, the toner band of cyan is also scraped off and removed by the cleaning blade 31.

In this manner, the intermediate transfer member 40 is driven to the extent that, in addition to the leading toner area located on the intermediate transfer member 40, the subsequent toner is also removed. Thus, the amount of toner remaining on the intermediate transfer member 40 is reduced more than that in the first exemplary embodiment.

In the exemplary embodiment, the intermediate transfer member 40 is driven to the extent that the toner band of cyan is removed. Alternatively, the intermediate transfer member 40 may be driven to the extent that the toner band of black or magenta is removed. Furthermore, the intermediate transfer member 40 may not necessarily be driven so that, as illustrated in FIGS. 7A and 7B, the cleaning blade 31 may be located between toner bands, and the driving of the intermediate transfer member 40 may be stopped after the cleaning blade 31 has scraped off the toner band of cyan, black, or magenta halfway. As illustrated in FIG. 6 and FIGS. 7A and 7B, at the time of cycle down, the toner band of cyan is cleaned off prior to the toner band of black. However, this cleaning order is merely a matter of design and is not limited to any specific order.

Third Exemplary Embodiment

Next, a third exemplary embodiment of the present invention will be described with reference to FIG. 8 and FIGS. 9A and 9B.

Figure 8:
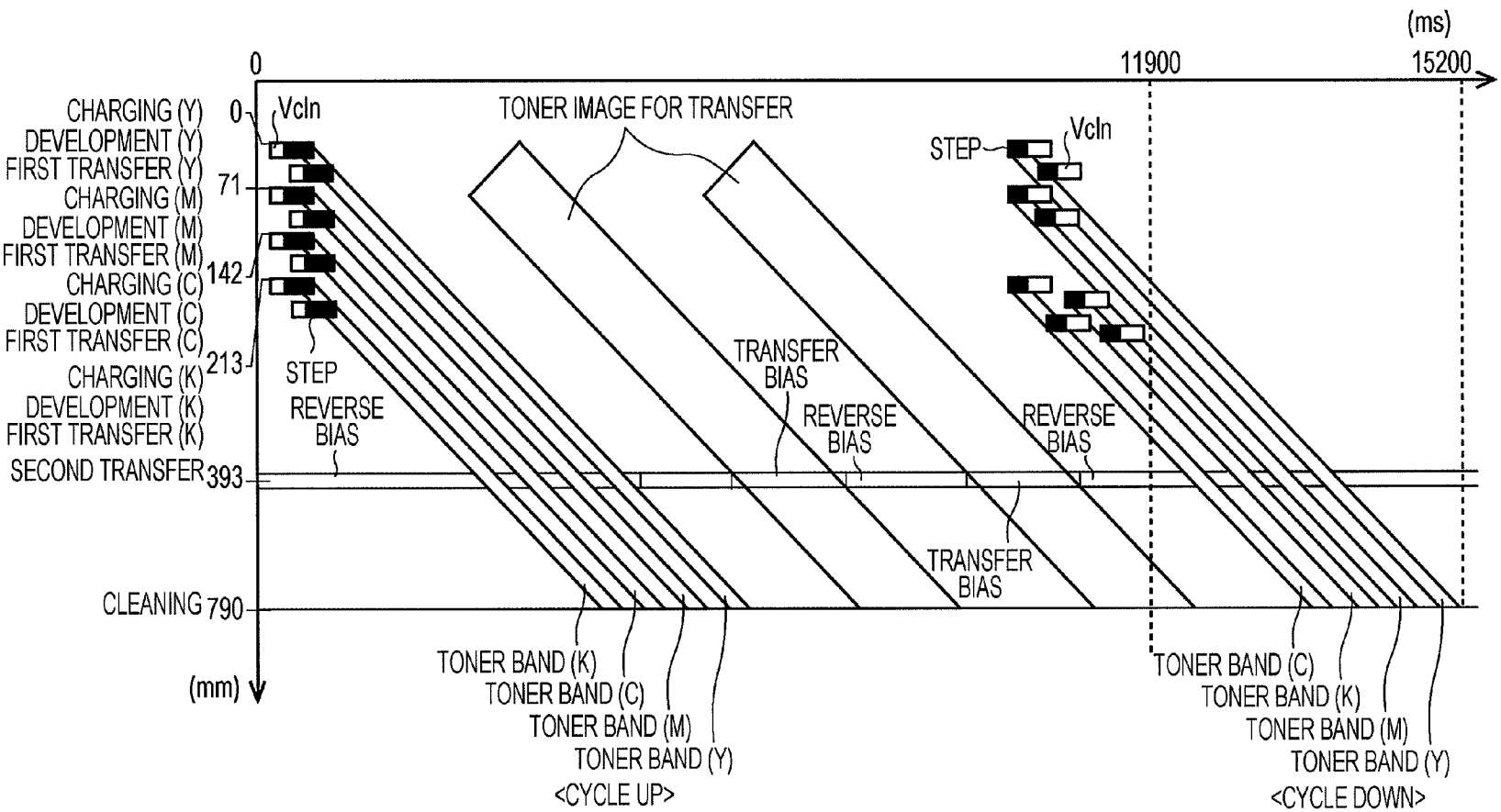
FIG. 8 illustrates an example of a print timing diagram according to a third exemplary embodiment.
Figure 9A:
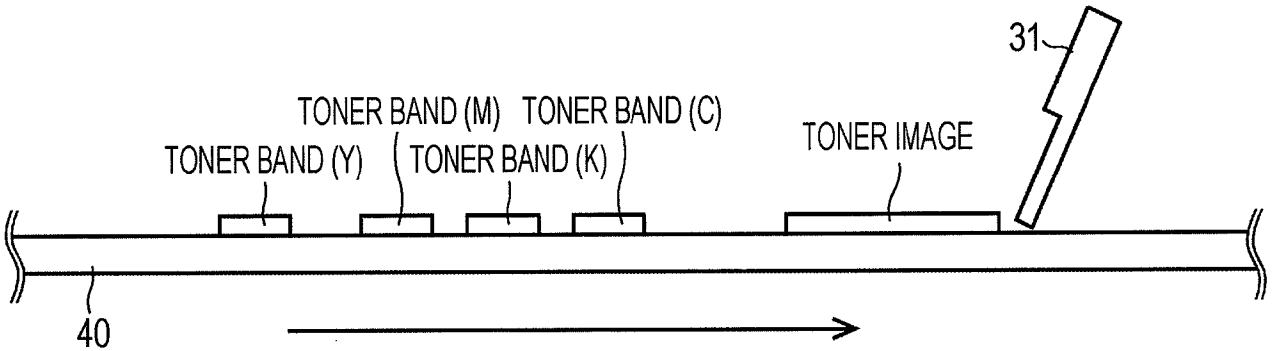
FIGS. 9A and 9B are conceptual diagrams illustrating removal of toner according to the third exemplary embodiment.
Figure 9B:
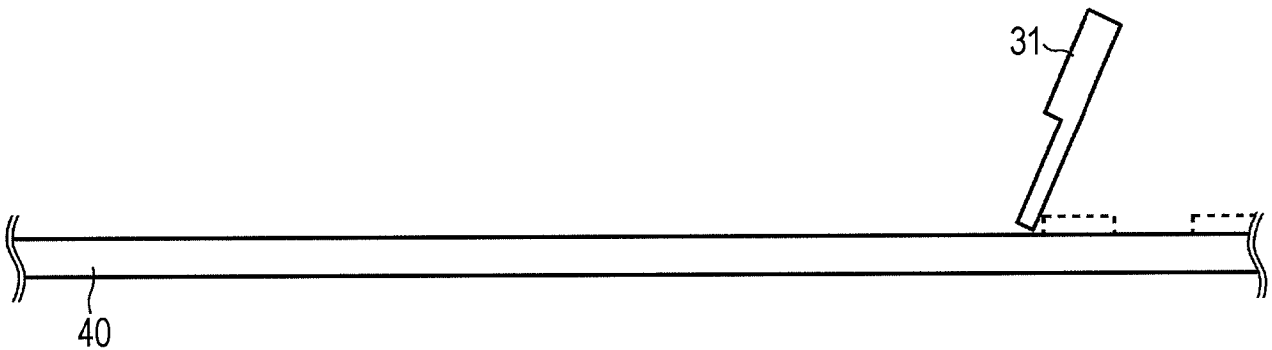

FIG. 8 illustrates an example of a print timing diagram according to the third exemplary embodiment, and FIGS. 9A and 9B are conceptual diagrams of removal of toner according to the third exemplary embodiment.

In the exemplary embodiment, the amount of driving of the intermediate transfer member 40 is further larger than that in the second exemplary embodiment. Specifically, as illustrated in FIG. 8, the driving of the intermediate transfer member 40 is not stopped at a time of 11900 ms, and the intermediate transfer member 40 is driven until around a time of 15200 ms. Consequently, as illustrated in FIGS. 9A and 9B, the toner image and all the toner bands are scraped off and removed by the cleaning blade 31.

In this manner, the intermediate transfer member 40 is driven to the extent that the toner bands up to the trailing toner band of yellow located on the intermediate transfer member 40 are removed. Thus, the amount of toner remaining on the intermediate transfer member 40 is reduced more than that in the first or second exemplary embodiment. This maximally prevents residual toner on the intermediate transfer member 40 from staining the user's clothing or the like during the replacement of the intermediate transfer member 40.

While some exemplary embodiments of the present invention have been described in detail, the present invention is not to be limited to specific exemplary embodiments of the present invention, and a variety of modifications and changes may be made without departing from the scope of the present invention as defined in the appended claims. For example, the individual values illustrated in FIGS. 4, 6, and 8 may be changed as appropriate in accordance with design. Further, the image forming apparatus 100 may be provided with a clutch to bring the photoconductor drums 25 of yellow, magenta, and cyan into contact or out-of-contact with the intermediate transfer member 40. Driving the intermediate transfer member 40 with the photoconductor drums 25 of yellow, magenta, and cyan being brought into out-of-contact with the intermediate transfer member 40 prevents the abrasion of the photoconductor drums 25 of yellow, magenta, and cyan.

It is to be understood that, for example, a program according to an exemplary embodiment of the present invention may be provided via a communication medium or may be provided by being stored in a recording medium such as a compact disc read-only memory (CD-ROM). Furthermore, for example, the components illustrated in the block diagrams described above may be implemented by hardware such as an assembly of logic circuits. In addition, the term "user" as described above may include the so-called end user, and persons involved in manufacturing an image forming apparatus, such as a person who examines the image forming apparatus before the shipment of the image forming apparatus.

Moreover, in the first to third exemplary embodiments described above, the controller 10 is configured to change the driving time of the intermediate transfer member 40 after the completion of image formation or change the driving time so that the driving of the intermediate transfer member 40 is driven until the end of the toner area remaining on the intermediate transfer member 40 reaches the cleaning device 30 in accordance with information about the life of the intermediate transfer member 40. Alternatively, the controller 10 may also be configured to make changes so that the trailing end of the toner remaining on the intermediate transfer member 40 reaches an unexposed portion of the intermediate transfer member 40 which is not exposed to the outside. For example, when the intermediate transfer member 40 is covered by a housing or a cover having at least one opening, the unexposed portion of the intermediate transfer member 40 may be any portion except for the opening or openings.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier member that carries a toner image;

an intermediate transfer member to which the toner image carried on the image carrier member is first-transferred;

a transfer unit that second-transfers the toner image first-transferred to the intermediate transfer member onto a recording medium;

an intermediate transfer member cleaning unit that removes residual toner on the intermediate transfer member after the second transfer; and a driving controller that, after completion of image formation and driving of the intermediate transfer member is stopped before completion of removal of residual toner, drives the intermediate transfer member for an amount of time for a trailing end of residual toner left on the intermediate transfer member to reach the intermediate transfer member cleaning unit.

2. An image forming apparatus comprising:

an image carrier member that carries a toner image;

an intermediate transfer member to which the toner image carried on the image carrier member is first-transferred;

a transfer unit that second-transfers the toner image first-transferred to the intermediate transfer member onto a recording medium;

an intermediate transfer member cleaning unit that removes residual toner on the intermediate transfer member after the second transfer; and a driving controller that, after the toner image is second-transferred onto the recording medium and and driving of the intermediate transfer member is stopped before completion of removal of residual toner, drives the intermediate transfer member for an amount of time for a trailing end of residual toner left on the intermediate transfer member to reach the intermediate transfer member cleaning unit from a position of the second transfer.

3. The image forming apparatus according to claim 1, further comprising a display that displays a state of the image forming apparatus, wherein in accordance with an indication on the display that indicates replacement of the intermediate transfer member, the driving controller changes the driving time of the intermediate transfer member after completion of image formation so that the driving of the intermediate transfer member is driven until an end of residual toner area on the intermediate transfer member reaches the cleaning unit.

4. The image forming apparatus according to claim 2, further comprising a display that displays a state of the image forming apparatus, wherein in accordance with an indication on the display that indicates replacement of the intermediate transfer member, the driving controller changes the driving time of the intermediate transfer member after completion of image formation so that the driving of the intermediate transfer member is driven until an end of residual toner area on the intermediate transfer member reaches the cleaning unit.

5. An image forming apparatus comprising:

an image carrier member that carries a toner image;

an intermediate transfer member to which the toner image carried on the image carrier member is first-transferred;

a transfer unit that second-transfers the toner image first-transferred to the intermediate transfer member onto a recording medium;

a cleaning unit that removes residual toner on the intermediate transfer member after the second transfer;

a driving controller that changes a driving time of the intermediate transfer member after completion of image formation; and a comparison unit that compares an operating state of the intermediate transfer member with a predetermined operating state, wherein in accordance with a comparison result, the driving controller drives the intermediate transfer member until an end of residual toner area on the intermediate transfer member reaches the cleaning unit.

6. An image forming apparatus comprising:

an image carrier member that carries a toner image;

an intermediate transfer member to which the toner image carried on the image carrier member is first-transferred;

a transfer unit that second-transfers the toner image first-transferred to the intermediate transfer member onto a recording medium;

a cleaning unit that removes residual toner on the intermediate transfer member after the second transfer;

a driving controller that changes a driving time of the intermediate transfer member after completion of image formation so that the intermediate transfer member is driven until an end of residual toner area on the intermediate transfer member reaches the cleaning unit; and a comparison unit that compares an operating state of the intermediate transfer member with a predetermined operating state, wherein in accordance with a comparison result, the driving controller drives the intermediate transfer member until an end of residual toner area on the intermediate transfer member reaches the cleaning unit.

7. The image forming apparatus according to claim 1, further comprising an input unit that receives an input to replace the intermediate transfer member, wherein in accordance with the input received by the input unit, the driving controller changes the driving time of the intermediate transfer member after completion of image formation so that the driving of the intermediate transfer member is driven until an end of a residual toner area on the intermediate transfer member reaches the cleaning unit.

8. The image forming apparatus according to claim 2, further comprising an input unit that receives an input to replace the intermediate transfer member, wherein in accordance with the input received by the input unit, the driving controller changes the driving time of the intermediate transfer member after completion of image formation so that the driving of the intermediate transfer member is driven until an end of a residual toner area on the intermediate transfer member reaches the cleaning unit.

9. An image forming apparatus comprising:

an image carrier member that carries a toner image;

an intermediate transfer member to which the toner image carried on the image carrier member is first-transferred;

a transfer unit that second-transfers the toner image first-transferred to the intermediate transfer member onto a recording medium;

a cleaning unit that removes residual toner on the intermediate transfer member after the second transfer; and an input unit that receives an input to replace the intermediate transfer member, wherein when the input unit receives the input and when driving of the intermediate transfer member is stopped before a trailing end of residual toner on the intermediate transfer member reaches the cleaning unit, the intermediate transfer member is driven until the trailing end of the residual toner reaches the cleaning unit.

10. An image forming apparatus comprising:

an image carrier member that carries a toner image;

an intermediate transfer member to which the toner image carried on the image carrier member is first-transferred;

a transfer unit that second-transfers the toner image first-transferred to the intermediate transfer member onto a recording medium;

a cleaning unit that removes residual toner on the intermediate transfer member after the second transfer; and a controller that sets a driving amount for driving the intermediate transfer member after completion of image formation so that a trailing end of residual toner left on the intermediate transfer member reaches the cleaning unit, wherein the drive amount is set according to an operation state of the intermediate transfer member.

11. The image forming apparatus according to claim 10, further comprising an input unit that receives an input by a user, wherein the controller drives the intermediate transfer member by the driving amount in accordance with the input.

12. The image forming apparatus according to claim 10, wherein the controller drives the intermediate transfer member in a forward direction.

13. The image forming apparatus according to claim 10, further comprising a comparison unit that compares an operating state of the intermediate transfer member with a threshold operating state, wherein, when the comparison indicates that the operating state has exceeded the threshold state, the driving controller drives the intermediate transfer member by the driving amount.

14. The image forming apparatus according to claim 11, further comprising a comparison unit that compares an operating state of the intermediate transfer member with a threshold operating state, wherein, when the comparison indicates that the operating state has exceeded the threshold state, the image forming apparatus prompts the user whether to replace the intermediate transfer member, and in response to an input indicating to replace the intermediate transfer member, the driving controller drives the intermediate transfer member by the driving amount.

15. The image forming apparatus according to claim 10, further comprising:

a memory that stores a threshold operating state of the intermediate transfer member; and a comparison unit that obtains an operating state of the intermediate transfer member, and compares the obtained operating state with the stored threshold operating state, wherein, when the comparison indicates that the operating state has exceeded the threshold operating state, the controller drives the intermediate transfer member by the driving amount.

16. The image forming apparatus according to claim 10, wherein the driving amount is a distance or a time.

17. The image forming apparatus according to claim 16, wherein the driving amount varies according to a size of the image forming apparatus or an arrangement of components within the image forming apparatus.

18. The image forming apparatus of claim 1, wherein the driving controller changes the amount of time in accordance with an operating state of the intermediate transfer member.

19. The image forming apparatus of claim 2, wherein the driving controller changes the amount of time in accordance with an operating state of the intermediate transfer member.

20. The image forming apparatus of claim 2, wherein the trailing end is a trailing end of a residue of at least one toner band of a plurality of toner bands of respective colors.

* * * * *